United States Patent [19]

Kemp, Jr. et al.

[11] Patent Number: 4,847,045

[45] Date of Patent: Jul. 11, 1989

[54] PROCESS FOR PRODUCING TUNGSTEN HEAVY ALLOY SHEET

[75] Inventors: Preston B. Kemp, Jr., Athens; Walter A. Johnson, Towanda, both of Pa.

[73] Assignee: GTE Products Corporation, Stamford, Conn.

[21] Appl. No.: 161,536

[22] Filed: Feb. 29, 1988

[51] Int. Cl.[4] ..... B22F 1/00

[52] U.S. Cl. ..... 419/36; 75/248; 419/58; 419/60

[58] Field of Search ..... 75/248; 419/60, 58, 419/36

[56] References Cited

U.S. PATENT DOCUMENTS 4,744,944 5/1988 Spencer et al. ..... 75/248

4,765,951 8/1988 Kemp ..... 419/46

*Primary Examiner*—Stephen J. Lechert, Jr.

*Attorney, Agent, or Firm*—Donald R. Castle; L. Rita Quatrini

[57] ABSTRACT

A process is disclosed for producing a sheet of tungsten heavy alloy which involves uniformly blending elemental metal powder components of the alloy by forming a slurry of the powder components in a liquid medium, introducing the slurry onto a filter medium and applying vacuum to the bottom of the slurry to form a planar cake of the powder components. The cake is then dried and sintered to a density equal to or greater than about 90% of the theoretical density of the alloy to form the sheet.

7 Claims, 3 Drawing Sheets

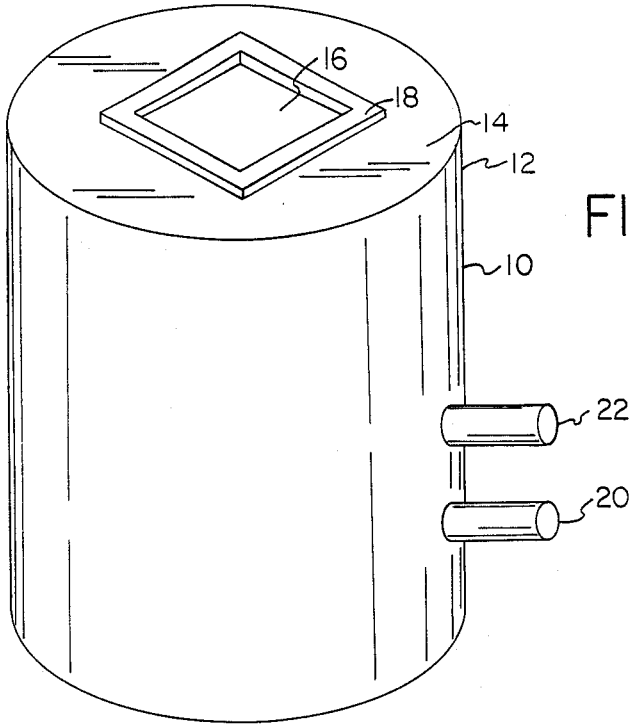
FIG.1
FIG.2
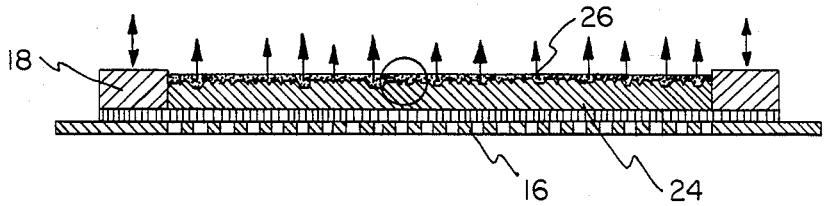
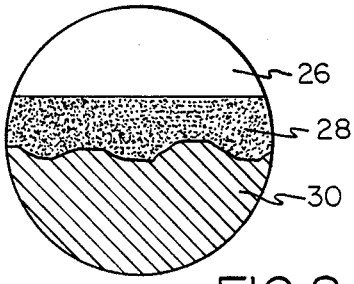
FIG.2a

PROCESS FOR PRODUCING TUNGSTEN HEAVY ALLOY SHEET

This invention relates to a process for producing tungsten heavy alloy sheet in which a sintered cake is first formed which is substantially close in thickness to the final thickness of the rolled sheet.

BACKGROUND OF THE INVENTION

Tungsten heavy alloy sheet can be produced by rolling sintered slabs of the alloy. Because the rolling requires numerous anneals it is desirable that the starting slab be no more than about twice the final thickness. One method to produce these slabs is by isostatically pressing the powder alloy blends and sintering them to full density. With thin slabs it is difficult to get a uniform fill of the mold so the resulting slabs are not uniform in thickness. There is also a problem with breakage with the thin slabs. Using this method it is not possible to produce slabs with a surface area to thickness ratio much over 600 or thickness less than about 0.5".

Another method of making tungsten heavy alloy sheet is to press large billets and cut the green billet into thin slabs. While this process produces slabs of uniform thickness it has the size limitations of the previous method and there is the added expense of cutting.

It would be desirable to make a sheet preform substantially close in thickness to the final thickness of the rolled sheet. This would reduce the time, energy and labor required for hot rolling and annealing.

SUMMARY OF THE INVENTION

In accordance with one aspect of this invention, there is provided a process for producing a sheet of tungsten heavy alloy which involves uniformly blending elemental metal powder components of the alloy by forming a slurry of the powder components in a liquid medium, introducing the slurry onto a filter medium and applying vacuum to the bottom of the slurry to form a planar cake of the powder components. The cake is then dried and sintered to a density equal to or greater than about 90% of the theoretical density of the alloy to form the sheet.

BRIEF DESCRIPTION OF THE DRAWINGS

FIG. 1 is an overall view of a preferred filtration apparatus used to form the planar cake.

FIG. 2 is a drawing showing how the slurry on the filter medium is vibrated and the movement of the gas out of the slurry.

FIG. 2*a* is a drawing showing the layering of the atmosphere, liquid medium, and settled powder on the filter medium.

DETAILED DESCRIPTION OF THE INVENTION

Figure 3:
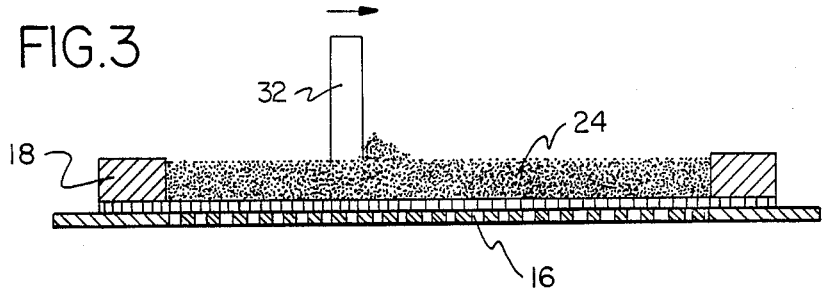
FIG. 3 is a drawing showing the leveling of the slurry with a doctor blade.

For a better understanding of the present invention, together with other and further objects, advantages and capabilities thereof, reference is made to the following disclosure and appended claims in connection with the above described drawings and description of some of the aspects of the invention.

The process of the present invention relates to formation of a planar cake of the component powders of the tungsten heavy alloy. This cake can then be processed to form a sintered sheet which is substantially close in thickness to the final thickness of the rolled sheet. As a result of formation of this type of cake, there is a reduction in the time, energy and labor required for hot rolling and annealing.

Some tungsten heavy alloys which are especially suited to this invention, although the invention is not limited to these, are tungsten-iron-nickel alloys especially those in which the Ni:Fe weight ratio is from about 1:1 to about 9:1 and most preferably about 8:2. As an example of these preferred alloys are those having the following composition in percent by weight: about 8% Ni, 2% Fe, and the balance W, about 4% Ni, about 1% Fe, and the balance W, and about 5.6% Ni, about 1.4% Fe, and the balance W. The alloys can be with or without additions of Co and/or Cu.

The elemental metal powder components of the alloy are first uniformly blended. This is done by forming a slurry of the powders in a liquid medium. The liquid medium can be water or organic solvents, which can be oxygen containing or non-oxygen containing organic solvents. Typical oxygen containing organic solvents are alcohols, one in particular being a reagent alcohol which is about 90% by weight ethyl alcohol, about 5% by weight methyl alcohol, and about 5% by weight isopropyl alcohol. Other solvents that can be used are alkane hydrocarbon liquids and chlorinated hydrocarbon liquids. The slurry can have other components such as organic or inorganic binders, etc. The actual formation of the slurry can be done by standard methods.

The liquid medium is then removed from the powders by applying vacuum to the bottom of a porous filter medium beneath the slurry. Vibration can also be used if this is desirable. Vibration can be applied before or during application of vacuum. This is done in such a way so that the powders form into a planar cake which is substantially close in thickness to the thickness of the final rolled sheet. The thickness of the sheet is typically from about 0.1" to about 0.5" after sintering and before rolling. By a planar cake is meant that the cake is uniform in thickness and density and is uniform in composition across the length and width of the cake. At this point, the composition of the cake may not be completely uniform throughout the thickness because tungsten powder would tend to settle faster than the other components. However, during the subsequent sintering step, compositional variations essentially disappear and the composition becomes substantially uniform throughout its thickness. The liquid removal can be accomplished by batch or continuous processing.

Figure 4:
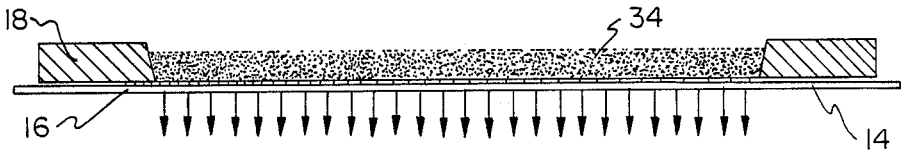
FIG. 4 is a drawing showing the removal of liquid medium from the slurry.
Figure 5D:
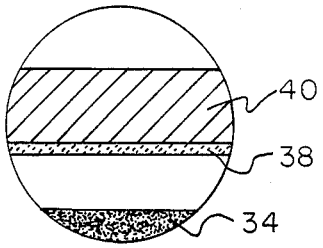
FIG. 5*a*, 5*b*, 5*c* and 5*d* are drawings showing the steps in removing the planar cake from the filtration apparatus.
Figure 5A:
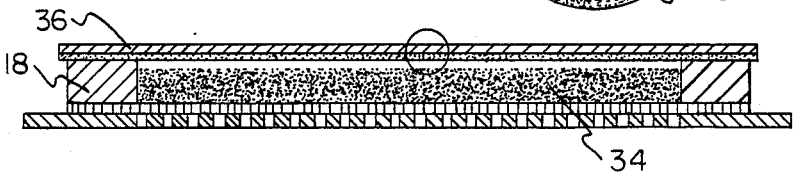
Figure 5B:
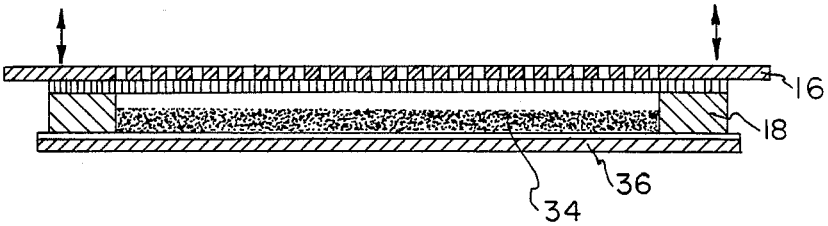
Figure 5C:
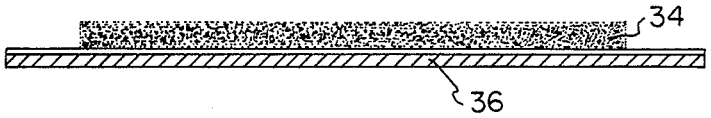

A typical filtration apparatus for forming the planar cake by the above described preferred procedure is shown in FIG. 1 as (10). A container or drum (12) is shown with its top (14) through which there is an opening. Over this opening is a filter media (16). The filter media is usually porous plastic or preferably, stainless steel filter cloth. The filter media is removably mounted to the top of the container so that the filter media is level and has no wrinkles. The preferred means of mounting the filter media to the container top is a frame shown as (18) the shape of which defines the shape of the cake which is to be formed. The frame is preferably made from PVC sheet of sufficient thickness to secure the filter media to the top of the container and to hold the shape of the cake. The thickness of the frame usually depends on the desired thickness of the cake. The slurry is introduced onto the filter media (16). The liquid medium passes through the media into the inside of the container (12). The powder settles onto the filter media. During the filtration, vacuum is applied from a conventional vacuum source as shown by the vacuum line connection (20), with vent (22) to atmosphere or gas source which allows the top to be released from the container. The frame is releasably mounted to the container top such as by bolts. FIG. 2 shows how the slurry (24) on the filter medium is vibrated and the movement (shown by the arrows) of entrapped gas (26) out of the slurry. The slurry is vibrated in the vertical plane and trapped gas bubbles (26) consolidate and move to the top of the slurry. FIG. 2*a* shows the layering of the gas or atmosphere (26), liquid medium (28) and settled powder (30) on the filter media (16) after the vibration. The settled powder of which the cake is to be formed is retained on the filter media. FIG. 3 shows the leveling of the slurry (24) with a doctor blade (32). FIG. 4 shows removal of the liquid medium from the slurry to form the cake (34). Arrows indicate the direction of the liquid medium directed out from the bottom of the slurry. FIGS. 5*a*, 5*b*, 5*c*, and 5*d* show the steps of removal of the plaar cake (34) from the filtration apparatus. FIG. 5*a* shows a ceramic coated molybdenum substrate sheet (36) clamped to the top of the filter frame (18). FIG. 5*d* shows the layering of the molybdenum sheet showing the zicronia coating (38), the molybenum (40), and the cake (34). FIG. 5*b* shows the resulting assembly of filter media, cake, filter frame and substrate having been inverted and vibration in the vertical plane allows the cake to be released onto the substrate sheet. FIG. 5*c* shows the final planar cake (34) resting on the substrate sheet (36) after the filter frame is removed.

Figure 6:
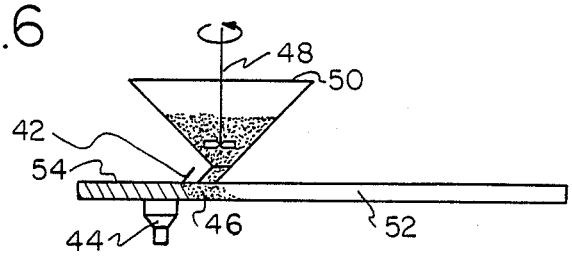
FIG. 6 is a drawing showing an arrangement of the doctor blade and the vacuum unit of another filtration apparatus of this invention.

In accordance with another embodiment the slurry is introduced onto a device which holds a filter medium which is usually rectangular in shape just before a doctor blade which levels the cake as it forms. A vacuum unit underneath and in contact with the filter medium applies a vacuum in a relatively narrow strip across the entire width of the cake just behind the doctor blade. Both the upper and lower portions of the above device move across the filter material to form a damp cake which is level across its width and length. FIG. 6 shows an arrangement of the doctor blade (42) and the vacuum unit (44) in the filtration apparatus. The slurry (46) being agitated by agitating means (48) in a container or slurry tank (50) and being poured onto filter media (52) and being leveled with doctor blade as described above. After the cake (54) is formed, it is removed from the filter medium. This is done preferably by removing the device and clamping a ceramic coated molybdenum substrate to the filter which will serve as the support for the cake. The entire unit is inverted and the cake is released onto the substrate, with the aid of vibration if necessary.

The resulting planar cake is then dried by conventional powder metal drying methods to remove essentially all the liquid therefrom, the methods being selected to reduce or eliminate cracking during drying. Any organic binders which may be present are removed by standard dewaxing techniques.

At this point if the liquid medium of the slurry has been water or an oxygen containing organic solvent, oxygen must be removed from the cake. This is done by heating the cake in hydrogen at a temperature sufficient to reduce any metal oxides which are present to their respective metals but below the normal sintering temperature of any metal contained therein. By "normal sintering temperature" is meant the temperature at which the cake is sintered to the final desired density. A minor amount of sintering can take place at this point and this is advantageous because it strengthens the cake and it is easier to handle if handling is necessary. This temperature is most typically from about 800° C. to about 1000° C. The time of heating depends of factors as the temperature, size of charge, thickness of the cake, nature of the equipment, etc. This step can be done separately or as part of the sintering operation.

The resulting dried and heated cake is then sintered by well known methods to a density at or near the theoretical density. This is considered to be equal to or greater than about 90% of the theoretical density of the alloy. Depending on the application and on the composition, the cake can be solid state or liquid phase sintered to form the sheet. For example, if the sheet is to be rolled, it is necessary to get the density to at least about 90% to about 93% of the theoretical. With a weight composition consisting essentially of about 7% Ni, about 3% Fe, and about 90% W, solid state sintering would be sufficient. Sintering temperatures and times depend on the nature of the alloy and on the density desired for the specific application. Typically, the solid state sintering temperature is from about 1400° C. to about 1430° C. Liquid phase sintering is preferable for better rolling, higher density and healing of cracks which can form during drying. Densities of about 99.4% of theoretical have been achieved in practice. Usually liquid phase sintering results in a more uniform composition of the alloy components throughout the sheet. The liquid phase sintering temperature is above the solidus temperature of the matrix phase of the alloy but below the melting point of tungsten.

The resulting sheet can now be processed by known methods of hot rolling and annealing to form the final size sheet. However, when the process of the present invention is followed to produce a sheet which is close to the desired final thickness, less rolling and annealing are required than with sheets formed by prior art methods. This is because the cake has been formed to a size very close to the desired size of the final sheet.

To more fully illustrate this invention, the following non-limiting example is presented.

EXAMPLE

A mixture of tungsten, nickel, and iron powder in the correct proportions for the alloy having a composition of about 4.9% Ni, about 2.1% Fe, and the balance W is mixed with water to form a slurry. The slurry is poured onto an $8'' \times 8'' \times \frac{1}{2}''$ filter having a construction as shown in FIG. 1 (porous plastic medium) and spread out uniformly with a spatula and doctor blade. Multiple passes are made with the doctor blade across the slurry while tapping the filter to bring entrapped air to the surface of the slurry. The slurry is vibrated perpendicular to the plane of the filter with an air vibrator. The final leveling is completed to a uniform thickness with a doctor blade. The volume is evacuated underneath the filter medium for about 5 to 10 minutes to remove excess water from the slurry, forming a planar cake. A sheet of zirconium oxide coated molybdenum is bolted down to the filter frame on top of the cake. The assembly is then inverted so the filter medium is above the cake and the cake is resting on the molybdenum sheet. The filter apparatus is vibrated to release the cake from the filter. The filter apparatus is removed leaving the damp cake on the molybdenum sheet. The cake is dried in a convection oven with no heat for about 24 hours. The cake is then solid state sintered in a hydrogen atmosphere. The cake shrinkage is about 15% in length and width, with the final dimensions being 6 3/16″×6 3/16″ and about 26% in thickness with final dimensions being 0.25″ thick. The cake is then liquid phase sintered in a hydrogen atmopshere. The liquid phase sintered cake is ground with an abrasive wheel to remove blisters occurring as a result of release of gasses during sintering. The resulting sheet preform is heat treated in hydrogen in preparation for rolling. The sheet is rolled down to about 0.230″ thick in 12 passes. This represents a reduction in height (RIH) of about 22% for the highest point on the sintered piece (0.295″). After this rolling step the piece measures about $7\frac{1}{8}''\times5\frac{7}{8}''\times0.175''$ thick. The sheet is annealed and rerolled to about 0.175″ thick (24% RIH). The length is from about $10\frac{1}{4}''$ to about $12\frac{1}{4}''$, the width is from about $5\frac{5}{8}''$ to about 6″, and the thickness is about 0.125″.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing a sheet of tungsten heavy alloy, said process comprising:

(a) uniformly blending elemental metal powder components of said alloy by forming a slurry of said powder components in a liquid medium;

(b) introducing said slurry onto a filter medium and applying vacuum to the bottom of said slurry to form a planar cake of said powder components;

(c) drying said cake; and (e) sintering said cake to a density equal to or greater than about 90% of the theoretical density of said alloy to form said sheet.

2. A process of claim 1 wherein said liquid medium is selected from the group consisting of water, oxygen containing organic solvents and non-oxygen containing organic solvents.

3. A process of claim 2 wherein said liquid medium is selected from the group consisting of water and oxygen-containing organic solvents.

4. A process of claim 3 wherein the dried cake before the sintering step is heated in hydrogen at a temperature sufficient to reduce any metal oxides which are present to their respective metals but below the sintering temperature of any metal contained therein.

5. A process of claim 4 wherein said temperature is from about 800° C. to about 1000° C.

6. A process of claim 1 wherein said filter medium is vibrated before application of said vacuum.

7. A process of claim 1 wherein said filter medium is vibrated during application of said vacuum.

* * * * *